US010829908B2

(12) United States Patent
Saitoh et al.

(10) Patent No.: US 10,829,908 B2
(45) Date of Patent: Nov. 10, 2020

(54) CONSTRUCTION MACHINE

(71) Applicant: Hitachi Construction Machinery Co., Ltd., Tokyo (JP)

(72) Inventors: Teppei Saitoh, Tokyo (JP); Kenji Hiraku, Tsuchiura (JP); Juri Shimizu, Tsuchiura (JP); Hiromasa Takahashi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/338,519

(22) PCT Filed: Nov. 16, 2017

(86) PCT No.: PCT/JP2017/041304
§ 371 (c)(1),
(2) Date: Apr. 1, 2019

(87) PCT Pub. No.: WO2018/097029
PCT Pub. Date: May 31, 2018

(65) Prior Publication Data

US 2019/0218750 A1 Jul. 18, 2019

(30) Foreign Application Priority Data

Nov. 24, 2016 (JP) ..... 2016-228291

(51) Int. Cl.
*E02F 9/22* (2006.01)
*F15B 20/00* (2006.01)
*E02F 3/36* (2006.01)

(52) U.S. Cl.
CPC ..... *E02F 9/2242* (2013.01); *E02F 3/3663* (2013.01); *E02F 9/22* (2013.01);
(Continued)

(58) Field of Classification Search
CPC ..... E02F 9/2292; E02F 9/268; E02F 9/2267; E02F 9/2289; E02F 9/2242; E02F 9/22; F15B 20/00
See application file for complete search history.

(56) References Cited

U.S. PATENT DOCUMENTS

| | | | | |
|---|---|---|---|---|
| 5,176,504 | A | 1/1993 | Moriya et al. | |
| 10,184,225 | B2 * | 1/2019 | Hiraku | E02F 9/2242 |
| 2016/0032565 | A1 | 2/2016 | Shimizu et al. | |

FOREIGN PATENT DOCUMENTS

| | | | |
|---|---|---|---|
| JP | 49-109778 | A | 10/1974 |
| JP | 55-153277 | U | 11/1980 |

(Continued)

OTHER PUBLICATIONS

International Search Report (PCT/ISA/210) issued in PCT Application No. PCT/JP2017/041304 dated Dec. 12, 2017 with English translation (five (5) pages).

(Continued)

*Primary Examiner* — Abiy Teka
(74) *Attorney, Agent, or Firm* — Crowell & Moring LLP

(57) ABSTRACT

This construction machine includes a first hydraulic drive device that is driven by a first prime mover and a second hydraulic drive device that is driven by a second prime mover. The first hydraulic drive device has a first closed circuit that connects a first hydraulic actuator and a first closed-circuit pump and a first assist flow path that connects the first closed circuit and a first open-circuit pump and that supplies pressure oil from the first open-circuit pump to the first closed circuit. The second hydraulic drive device is provided with a second closed circuit that connects a second hydraulic actuator and a second closed-circuit pump. The present invention also includes a first emergency flow path that branches from the first assist flow path and connects to (Continued)

the second closed circuit and that supplies pressure oil from the first open-circuit pump to the second closed circuit.

7 Claims, 11 Drawing Sheets

(52) U.S. Cl.
CPC ..... *E02F 9/2289* (2013.01); *E02F 9/2292* (2013.01); *F15B 20/00* (2013.01); *E02F 9/2267* (2013.01)

(56) References Cited

FOREIGN PATENT DOCUMENTS

| | | | | | |
|---|---|---|---|---|---|
| JP | 57-123332 | A | | 7/1982 | |
| JP | 57123332 | A | * | 7/1982 | ..... F25B 11/17 |
| JP | 61-204427 | A | | 9/1986 | |
| JP | 11-124879 | A | | 5/1999 | |
| JP | 2014-45665 | A | | 3/2014 | |

OTHER PUBLICATIONS

Japanese-language Written Opinion (PCT/ISA/237) issued in PCT Application No. PCT/JP2017/041304 dated Dec. 12, 2017 (four (4) pages).

* cited by examiner

CONSTRUCTION MACHINE

TECHNICAL FIELD

The present invention relates to a construction machine such as a hydraulic excavator.

BACKGROUND ART

In recent years, energy conservation has become an important development item in construction machines, such as hydraulic excavators and wheel loaders. For energy conservation of construction machines, it is important to conserve energy of the hydraulic system itself, and application of a hydraulic closed-circuit system in which a hydraulic pump and a hydraulic actuator are connected to configure a closed circuit has been considered. Since no control valve is provided between the hydraulic pump and the hydraulic actuator in this hydraulic closed-circuit system, there is no pressure loss caused by the control valve, and because the hydraulic pump discharges only the necessary flow rate, there is no flow loss.

As a background art of a construction machine equipped with this kind of hydraulic closed-circuit system, Patent Literature 1 discloses the configuration of a hydraulic closed-circuit system provided with a plurality of closed circuits that are each configured by connecting one of a plurality of variable displacement hydraulic pumps and one of a plurality of hydraulic actuators, and that circulate pressure oil between the variable displacement hydraulic pump and the hydraulic actuator.

Meanwhile, as a background technology of a large-sized hydraulic excavator, Patent Literature 2 discloses the configuration of a hydraulic excavator that drives a hydraulic system with two prime movers.

CITATION LIST

Patent Literature

PATENT LITERATURE 1: US Patent Publication No. 2016/0032565
PATENT LITERATURE 2: JP-A No. H11-124879

SUMMARY OF INVENTION

Technical Problem

If the large-sized hydraulic excavator equipped with the two prime movers as disclosed in Patent Literature 2 is configured such that all hydraulic actuators are operated by the plurality of hydraulic pumps connected to a single prime mover, even in the event one of the two prime movers becomes inoperative due to a failure or the like, it is possible to maintain the minimum operation of the hydraulic excavator with the other prime mover. Meanwhile, there has been a desire for applying a hydraulic closed-circuit system such as that disclosed in Patent Literature 1 even to a large-sized hydraulic excavator equipped with two prime movers to save energy.

However, the application of a hydraulic closed-circuit system, such as that disclosed in Patent Literature 1, to a hydraulic system in which all hydraulic actuators are driven by a single prime mover, increases the number of hydraulic pumps and directional solenoid valves, resulting in a new problem of an increase in the complexity and size of the hydraulic system.

Accordingly, with respect to a construction machine which operates a plurality of hydraulic actuators by driving a plurality of hydraulic pumps with at least two prime movers, the present invention has been achieved to address the problem of ensuring the minimum operations of the hydraulic actuators even in the event one of the prime movers is inoperative, while achieving energy conservation and miniaturization of a hydraulic system.

Solution to Problem

In order to address the above problem, for example, the configuration described in the claims is adopted. Although the present application includes a plurality of means for addressing the above problem, but the following is given as an example. A construction machine includes: a first prime mover; a first hydraulic drive device that has a plurality of first closed-circuit pumps and a plurality of first open-circuit pumps being driven by the first prime mover; a plurality of first hydraulic actuators that operate with pressure oil supplied from at least one of the plurality of first closed-circuit pumps and the plurality of first open-circuit pumps; a second prime mover; a second hydraulic drive device that has a plurality of second closed-circuit pumps and a plurality of second open-circuit pumps being driven by the second prime mover; and a plurality of second hydraulic actuators that operate with pressure oil supplied from at least one of the plurality of second closed-circuit pumps and the plurality of second open-circuit pumps. The first hydraulic drive device has a plurality of first closed circuits that each connect one of the plurality of first hydraulic actuators and one of the plurality of first closed-circuit pumps, and a plurality of first assist flow paths that each connect one of the plurality of first closed circuits and one of the plurality of first open-circuit pumps and that supply pressure oil from the first open-circuit pump to the first closed circuit. The second hydraulic drive device is provided with a plurality of second closed circuits that each connect one of the plurality of second hydraulic actuators and one of the plurality of second closed-circuit pumps. The construction machine further includes at least one first emergency flow path that branches from one of the plurality of first assist flow paths and connects to one of the plurality of second closed circuits and that supplies pressure oil from the first open-circuit pump to the second closed circuit, a first assist switching device for guiding pressure oil flowing through the first assist flow path to the first emergency flow path, and a control device that controls operation of the first assist switching device.

Advantageous Effects of Invention

According to the present invention, with respect to a construction machine which operates a plurality of hydraulic actuators by driving a plurality of hydraulic pumps with at least two prime movers, it is possible to ensure the minimum operations of the hydraulic actuators even in the event one of the prime movers is inoperative, while achieving energy conservation and miniaturization of a hydraulic system. It should be noted that problems, configurations, and effects other than those described above will become apparent from the following description of embodiments.

DESCRIPTION OF EMBODIMENTS

Hereinafter, embodiments of the present invention will be described with reference to the drawings, taking as an example a large-sized hydraulic excavator serving as a construction machine. It should be noted that the application of the present invention is not limited to hydraulic excavators, but also may include general construction machines provided with a hydraulic closed-circuit system, which is equipped with two or more prime movers and which is configured such that a closed-circuit pump and a hydraulic cylinder are connected to constitute a closed circuit and an open-circuit pump is connected to the closed circuit so as to allow hydraulic oil to be supplied from the open-circuit pump to the head-side oil chamber of the hydraulic cylinder.

First Embodiment

Figure 1:
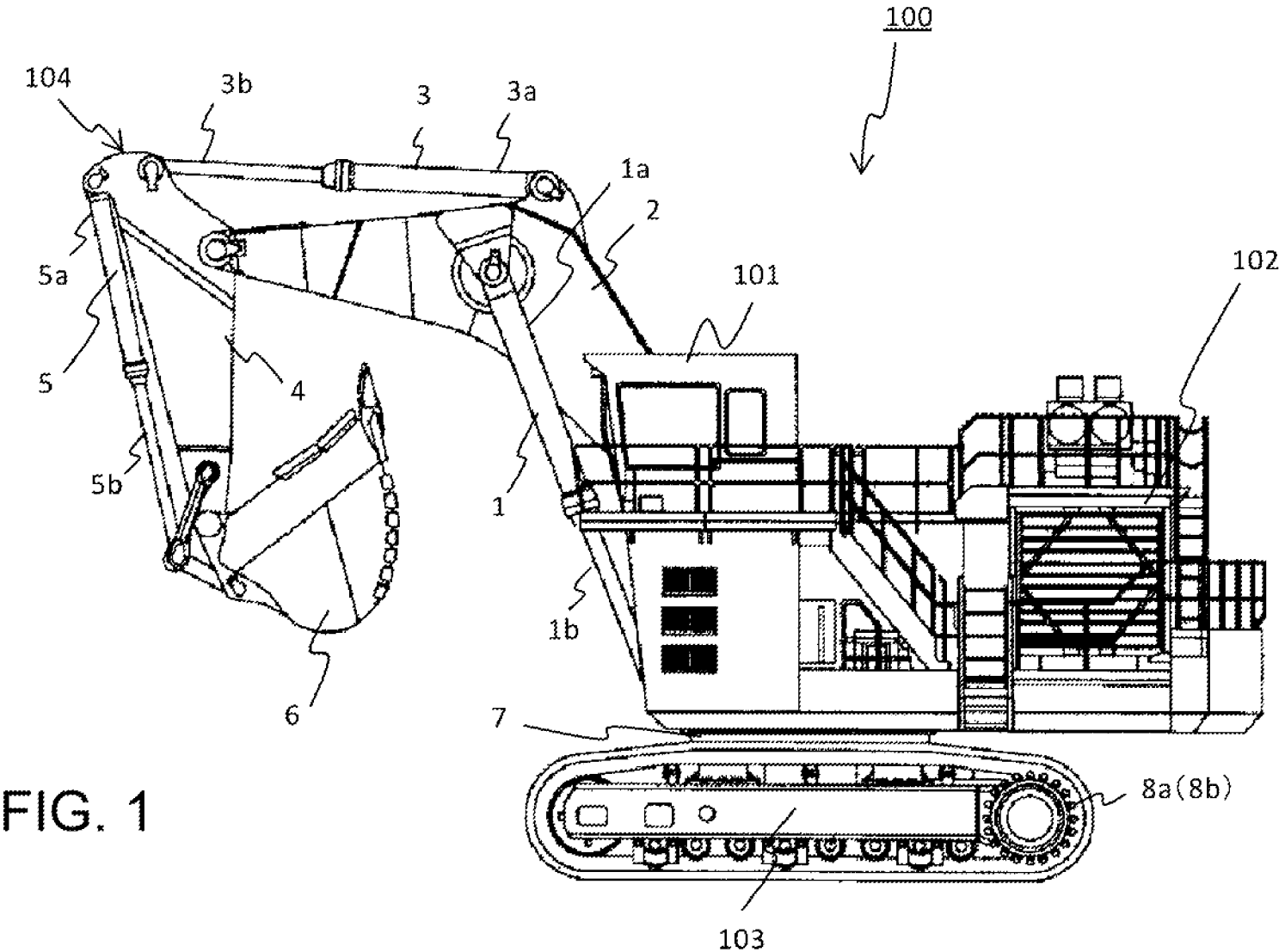
FIG. 1 is a side view of a hydraulic excavator according to a first embodiment of the present invention.

FIG. 1 is a side view of a hydraulic excavator according to a first embodiment of the present invention. In the following description, it is assumed that the front, rear, left and right directions shall be determined as viewed from an operator who operates the hydraulic excavator. Therefore, for example, the left-right direction in FIG. 1 is the front-rear direction of the hydraulic excavator.

As shown in FIG. 1, a hydraulic excavator 100 according to this embodiment includes an undercarriage (travel base) 103 that is provided with crawler-mounted travel devices 8*a*, 8*b* on both sides in the left-right direction and an upperstructure 102 that is turnably mounted on the undercarriage 103. A cab 101 where an operator sits is disposed on the upperstructure 102.

At the front of the upperstructure 102, a front working device (working device) 104 for conducting work, such as excavation work, is mounted so as to be capable of upward and downward movement. The front working device 104 is provided with a boom 2, a single-rod boom cylinder 1 for driving the boom 2, an arm 4, a single-rod arm cylinder 3 for driving the arm 4, a bucket 6, and a single-rod bucket cylinder 5 for driving the bucket 6. With respect to the boom cylinder 1, the leading end of a boom rod 1*b* is connected to the upperstructure 102, and the base end of a boom head 1*a* is connected to the boom 2. With respect to the arm cylinder 3, the leading end of an arm rod 3*b* is connected to the arm 4, and the arm head 3*a* of the arm cylinder 3 is connected to the boom 2. With respect to the bucket cylinder 5, the leading end of a bucket rod 5*b* is connected to the bucket 6, and the base end of the bucket head 5*a* of the bucket cylinder 5 is connected to the arm 4.

An operating device 19 (see FIG. 2) for travel/swing operations and for operating the boom 2, the arm 4, and the bucket 6 is disposed in the cab 101. The operating device 19 is provided with a plurality of operating levers 19*a* to 19*d*. The operating lever 19*a* enables an operator to provide instructions for moving the left-hand travel device 8*a* forward or backward, the operating lever 19*b* enables the operator to provide instructions for moving the right-hand travel device 8*b* forward or backward, the operating lever 19*c* enables the operator to provide instructions for turning the upperstructure 102 and causing the arm 4 to perform arm extending/arm retracting operation, and the operating lever 19*d* enables the operator to provide instructions for raising or lowering the boom 2 and causing the bucket 6 to perform bucket excavation/bucket dump operation.

Figure 2:
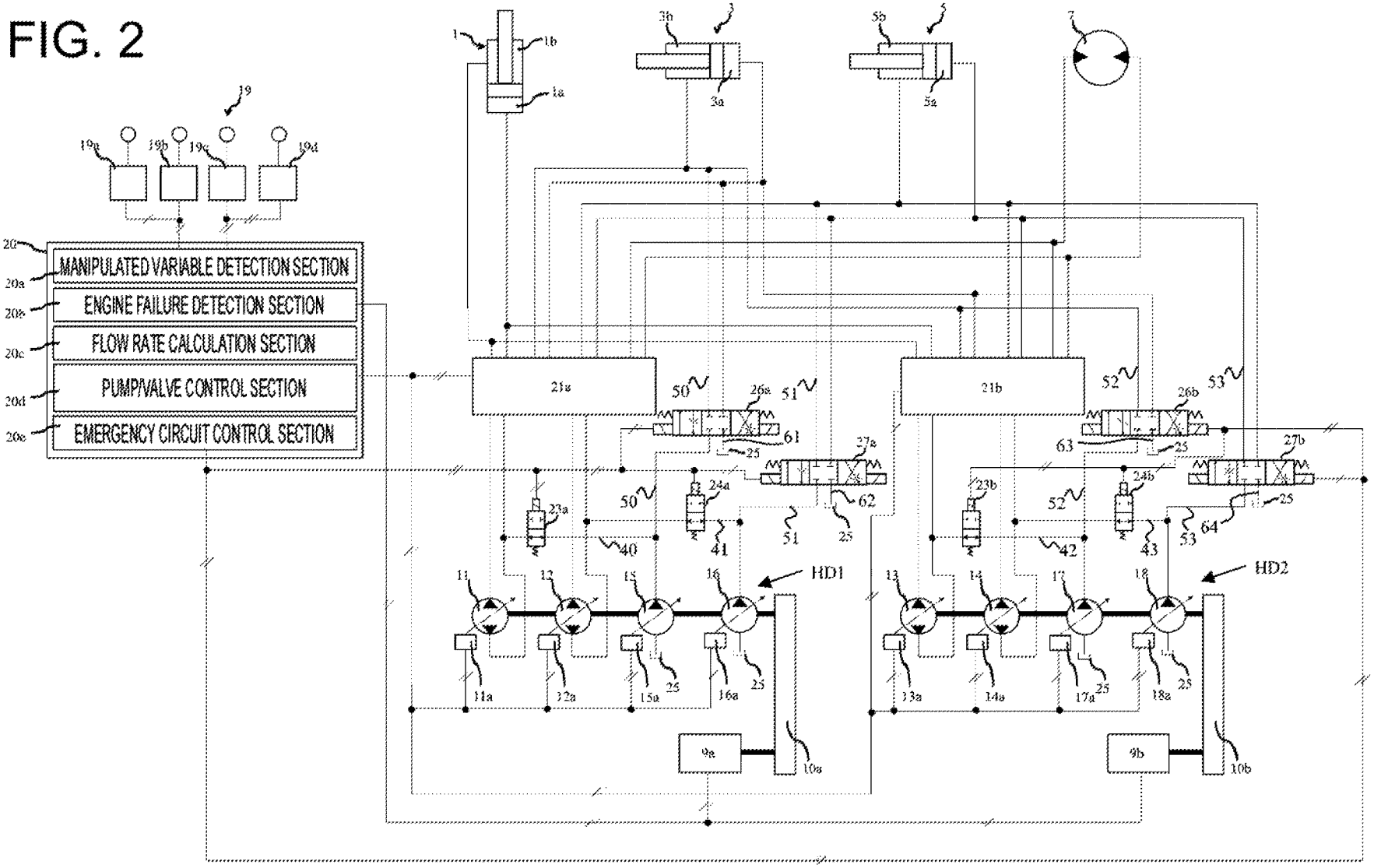
FIG. 2 is a hydraulic circuit diagram showing hydraulic drive devices for driving the hydraulic excavator and a control device according to the first embodiment of the present invention.

Next, the system configuration of hydraulic drive devices for driving the hydraulic excavator 100 will be described with reference to FIG. 2. FIG. 2 is a hydraulic circuit diagram showing hydraulic drive devices for driving the hydraulic excavator and a control device. In the following description, the closed circuit connecting a member "A" and a member "B" is denoted as closed circuit "A"–"B". For example, a closed circuit 11-1 is a closed circuit which connects a closed-circuit pump 11 and the boom cylinder 1.

As shown in FIG. 2, this embodiment includes: an engine (first prime mover) 9*a*; a first hydraulic drive device HD1 that is driven by the power transmitted from the engine 9*a* through a transmission device 10*a*; the boom cylinder (first hydraulic actuator) 1 and the arm cylinder (first hydraulic actuator) 3 that operate with the pressure oil supplied from the first hydraulic drive device HD1; an engine (second prime mover) 9*b*; a second hydraulic drive device HD2 that is driven by the power transmitted from the engine 9*b* through a transmission device 10*b*; and the bucket cylinder (second hydraulic actuator) 5 and the hydraulic motor (second hydraulic actuator) 7 that operate with the pressure oil supplied from the second hydraulic drive device HD2.

It should be noted that, although only one hydraulic motor 7 is shown in FIG. 2, a total of three hydraulic motors (hydraulic actuators) 7 are actually provided, one for driving the upperstructure 102 and two ones for driving the left and right travel devices 8*a*, 8*b*.

The first hydraulic drive device HD1 has: two closed-circuit pumps (first closed-circuit pumps) 11, 12 and two open-circuit pumps (first open-circuit pumps) 15, 16 that are connected to the engine 9*a*; four closed circuits that are configured by connecting the closed-circuit pump 11 to the boom cylinder 1, the arm cylinder 3, the bucket cylinder 5, and the hydraulic motor 7 via a flow path switching valve (first closed-circuit switching device) 21*a*; and four closed circuits that are configured by connecting the closed-circuit pump 12 to the boom cylinder 1, the arm cylinder 3, the bucket cylinder 5, and the hydraulic motor 7 via the flow path switching valve (first closed-circuit switching device) 21*a*.

More specifically, in addition to a closed circuit 11-1 and a closed circuit 12-3 that correspond to the "first closed circuit" in the present invention, the first hydraulic drive device HD1 has a closed circuit 11-3, a closed circuit 11-5, a closed circuit 11-7, a closed circuit 12-1, a closed circuit 12-5, and a closed circuit 12-7 (which is a first emergency closed circuit). Furthermore, the closed circuit through which pressure oil flows is determined by the operation of the flow path switching valve 21*a*. It should be noted that the operation of the flow path switching valve 21*a* is controlled by control signals from a control device 20.

The first hydraulic drive device HD1 also has: an assist flow path (first assist flow path) 40 that is connected to the closed circuit (for example, the closed circuit 11-1) configured by including the closed-circuit pump 11 and supplies the pressure oil from the open-circuit pump 15; and an emergency flow path (first emergency flow path) 50 that branches from the assist flow path 40 and supplies the pressure oil from the open-circuit pump 15 to the arm cylinder 3. The first hydraulic drive device HD1 also has: an assist flow path (first assist flow path) 41 that is connected to the closed circuit (for example, the closed circuit 12-3) configured by including the closed-circuit pump 12 and supplies the pressure oil from the open-circuit pump 16; and an emergency flow path (first emergency flow path) 51 that branches from the assist flow path 41 and supplies the pressure oil from the open-circuit pump 16 to the bucket cylinder 5.

Assist valves 23*a*, 24*a* are provided in the assist flow paths 40 and 41, respectively, and auxiliary control valves 26*a* and 27*a* are provided in the emergency flow paths 50, 51, respectively. By closing the assist valves 23*a*, 24*a* and opening the auxiliary control valves 26*a*, 27*a*, the pressure oil from the open circuit pumps 15, 16 can be supplied to the arm cylinder 3 and the bucket cylinder 5. The assist valves 23*a*, 24*a* and the auxiliary control valves 26*a*, 27*a* are controlled, as to the opening and closing or the flow path connecting direction, in accordance with the control command values from the control device 20. It is to be noted that the assist valves 23*a*, 24*a* and the auxiliary control valves 26*a*, 27*a* correspond to the "first assist switching device" in the present invention.

Furthermore, the pressure oil from the arm cylinder 3 returns to a tank (hydraulic oil tank) 25 from a hydraulic oil return flow path 61 via the auxiliary control valve 26*a*. Similarly, the pressure oil from the bucket cylinder 5 returns to the tank 25 from a hydraulic oil return flow path (first hydraulic oil return flow path) 62 via the auxiliary control valve 27*a*.

Similarly, the second hydraulic drive device HD2 has: two closed-circuit pumps (second closed-circuit pumps) 13, 14 and two open-circuit pumps (second open-circuit pumps) 17, 18 that are connected to the engine 9*b*; four closed circuits that are configured by connecting the closed-circuit pump 13 to the boom cylinder 1, the arm cylinder 3, the bucket cylinder 5, and the hydraulic motor 7 via a flow path switching valve (second closed-circuit switching device) 21*b*; and four closed circuits that are configured by connecting the closed-circuit pump 14 to the boom cylinder 1, the arm cylinder 3, the bucket cylinder 5, and the hydraulic motor 7 via the flow path switching valve 21*b*.

More specifically, in addition to a closed circuit 13-5 and a closed circuit 14-7 that correspond to the "second closed circuit" in the present invention, the second hydraulic drive device HD2 has a closed circuit 13-1 (second emergency closed circuit), a closed circuit 13-3, a closed circuit 13-7, a closed circuit 14-1, a closed circuit 14-3, and a closed circuit 14-5. The closed circuit through which pressure oil flows is determined by the operation of the flow path switching valve 21*b*. It should be noted that the operation of the flow path switching valve 21*b* is controlled by control signals from the control device 20.

The second hydraulic drive device HD2 also has: an assist flow path (second assist flow path) 42 that is connected to the closed circuit (for example, the closed circuit 13-5) configured by including the closed-circuit pump 13 and supplies the pressure oil from the open-circuit pump 17; and an emergency flow path (second emergency flow path) 52 that branches from the assist flow path 42 and supplies the pressure oil from the open-circuit pump 17 to the arm cylinder 3. The second hydraulic drive device HD2 also has: an assist flow path (second assist flow path) 43 that is connected to the closed circuit (for example, the closed circuit 14-7) configured by including the closed-circuit pump 14 and supplies the pressure oil from the open-circuit pump 18; and an emergency flow path (second emergency flow path) 53 that branches from the assist flow path 43 and supplies the pressure oil from the open-circuit pump 18 to the bucket cylinder 5.

Assist valves 23*b*, 24*b* are provided in the assist flow paths 42 and 43, respectively, and auxiliary control valves 26*b* and 27*b* are provided in the emergency flow paths 52, 53, respectively. By closing the assist valves 23*b*, 24*b* and opening the auxiliary control valves 26*b*, 27*b*, the pressure oil from the open circuit pumps 17, 18 can be supplied to the arm cylinder 3 and the bucket cylinder 5. The assist valves 23*b*, 24*b* and the auxiliary control valves 26*b*, 27*b* are controlled, as to the opening and closing or the flow path connecting direction, in accordance with the control command values from the control device 20. It is to be noted that the assist valves 23*b*, 24*b* and the auxiliary control valves 26*b*, 27*b* correspond to the "second assist switching device" in the present invention.

Furthermore, the pressure oil from the arm cylinder 3 returns to the tank 25 from a hydraulic oil return flow path (second hydraulic oil return flow path) 63 via the auxiliary control valve 26*b*. Similarly, the pressure oil from the bucket cylinder 5 returns to the tank 25 from a hydraulic oil return flow path 64 via the auxiliary control valve 27*b*.

In addition, the closed-circuit pumps 11 to 14 and the open-circuit pumps 15 to 18 are provided with: swash plate tilting mechanisms that each have a pair of input-output ports; and regulators 11*a* to 18*a* that adjust the pump displacement volume by adjusting the tilt angle of the swash plate. The regulators 11*a* to 18*a* control the delivery flow rates and the discharge directions of the closed-circuit pumps 11 to 14 and the delivery flow rates of the open-circuit pumps 15 to 18 in accordance with the pump delivery flow rate command values received from the control device 20 through signal lines. The suction port of each of the open-circuit pumps 15 to 18 is connected to the tank 25.

Figure 5:
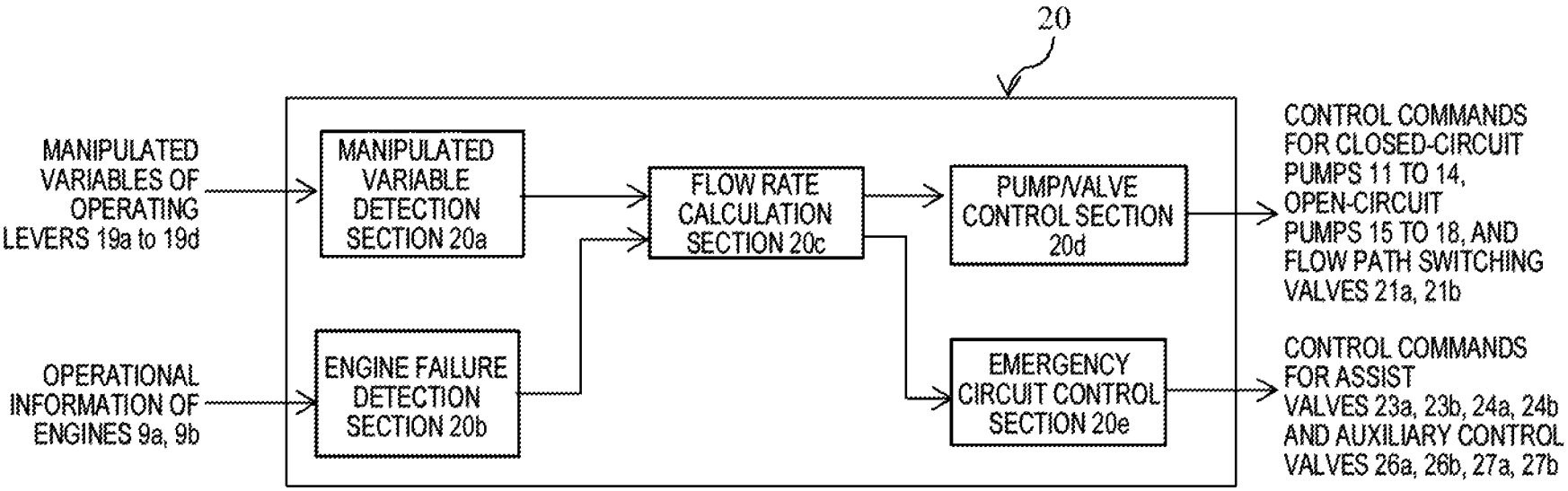
FIG. 5 is a conceptual diagram showing the configuration of a control device constituting the construction machine according to the first embodiment of the present invention.

Next, the details of the control device 20 will be described using FIG. 5. FIG. 5 is a block diagram showing the details of the control device 20. As shown in FIG. 5, the control device 20 is provided with a manipulated variable detection section 20*a*, an engine failure detection section 20*b*, a flow rate calculation section 20*c*, a pump/valve control section 20*d*, and an emergency circuit control section 20*e*. The operating levers 19*a* to 19*d* are connected to the control device 20 through signal lines. The manipulated variable detection section 20*a* detects the manipulated variables of the operating levers 19*a* to 19*d*.

The engine failure detection section 20*b* has the function of detecting a failure in the engines 9*a*, 9*b*. For example, the engine failure detection section 20*b* measures the engine rotational speed of the engines 9*a*, 9*b* input from an engine rotational speed detector (not shown), and, if the engine rotational speed is lower than a preset target engine rotational speed, determines failures.

The flow rate calculation section 20*c* determines the control flow rates of the hydraulic actuators (that is, the boom cylinder 1, the arm cylinder 3, the bucket cylinder 5, and the hydraulic motor 7) on the basis of the manipulated variables from the manipulated variable detection section 20*a* and the information from the engine failure detection section 20*b*. Note that the details of the flow rate calculation section 20*c* will be described later.

The pump/valve control section 20*d* outputs a control command signal to each equipment in accordance with the discharge flow rate command values of the closed-circuit pumps 11 to 14 and the open-circuit pumps 15 to 18 and the control command values of the flow path switching valves 21*a* and 21*b* as received from the flow rate calculation section 20*c*.

The emergency circuit control section 20*e* outputs a control command signal to each equipment in accordance with the control command values of the assist valves 23*a*, 23*b*, 24*a*, 24*b* and the control command values of the auxiliary control valves 26*a*, 26*b*, 27*a*, 27*b* as received from the flow rate calculation section 20*c*.

Figure 6:
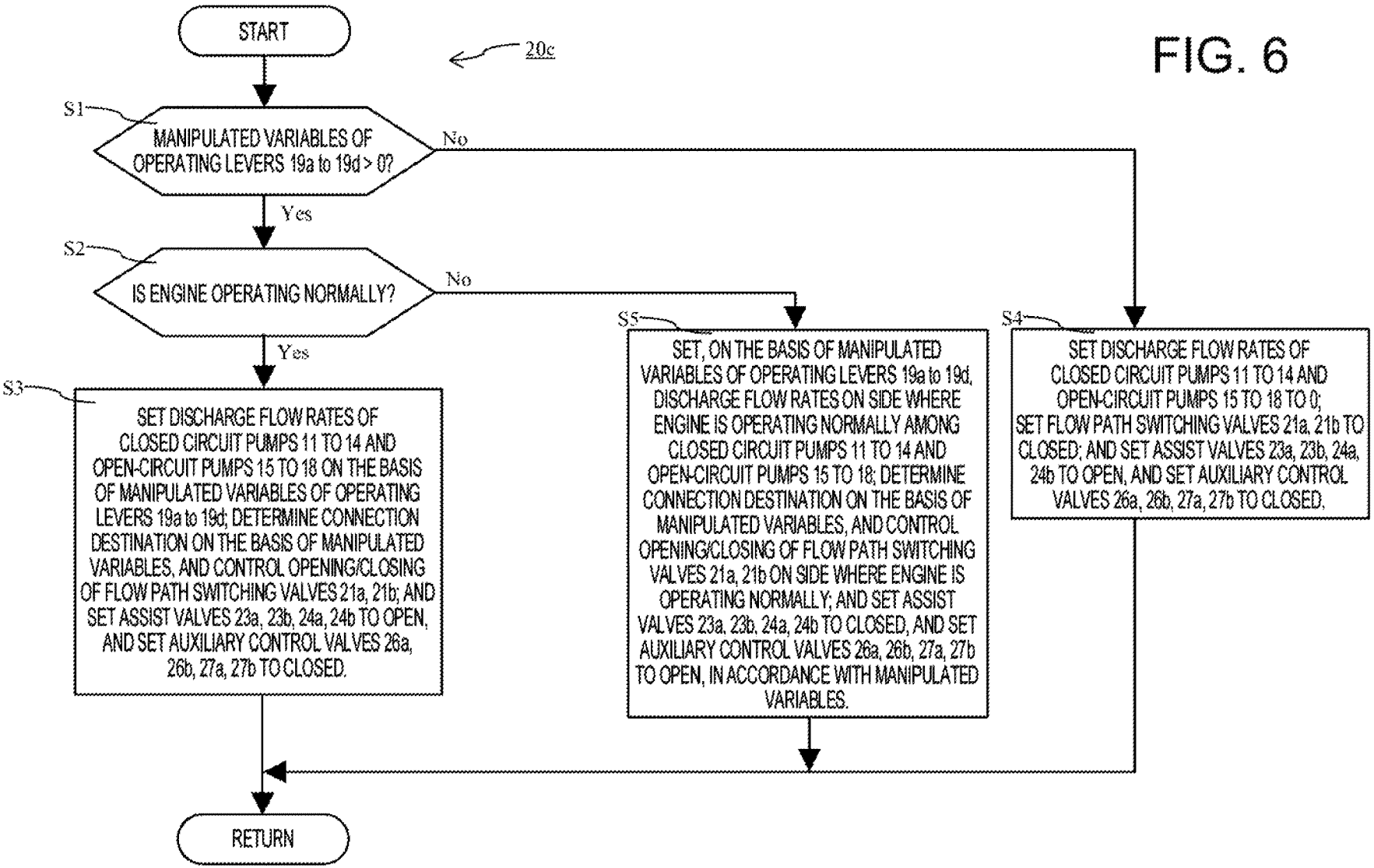
FIG. 6 is a flowchart showing the processing contents of a flow path calculation section of the control device constituting the construction machine according to the first embodiment of the present invention.

Next, the flow rate calculation section 20*c* will be described in detail using FIG. 6. FIG. 6 is a flowchart showing the processing contents of the flow path calculation section. As shown in FIG. 6, in step S1, if the manipulated variables from the manipulated variable detection section 20*a* are greater than 0, the process proceeds to step S2. Meanwhile, if the manipulated variables are 0, the process proceeds to step S4, where the discharge flow rate command values of the closed-circuit pumps 11 to 14 and the open-circuit pumps 15 to 18 are set to 0 and the control command values of the flow path switching valves 21*a*, 21*b* are set to Closed. Furthermore, the control command values of the assist valves 23*a* to 24*b* are set to Open, and the control command values of the auxiliary control valves 26*a* to 27*b* are set to Closed.

In the step S2, if it is determined that the engines 9*a*, 9*b* are operating normally on the basis of the information from the engine failure detection section 20*b*, the process proceeds to step S3. Meanwhile, if the engine 9*a* or the engine 9*b* is determined to be faulty, the process proceeds to step S5, where the discharge flow rates on the side where the engine is operating normally among the discharge flow rates of the closed-circuit pumps 11 to 14 and open-circuit pumps 15 to 18 which are to be set, for example, proportional to the manipulated variables, are set at discharge flow rate command values based on the manipulated variables of the operating levers 19*a* to 19*d*. The control command values of the flow path switching valves 21*a*, 21*b* on the side where the engine is operating normally are set to Open or Closed so as to connect the pumps and the actuators corresponding to the operating commands of the operating levers 19*a* to 19*d*. Furthermore, the control command values of the assist valves 23*a*, 23*b*, 24*a*, 24*b* are set to Closed, and the control command values of the auxiliary control valves 26*a* to 27*b* are set to Open so as to correspond to the operating commands of the operating levers 19*a* to 19*d*. It should be noted that, for example, in the event of failure of one of the engines, the step S5 may be executed after displaying the information relating to the failure of the engine to an operator with a monitor or the like once and obtaining the approval of the operator.

In the step S3, the discharge flow rate command values of the closed-circuit pumps 11 to 14 and open-circuit pumps 15 to 18, for example, proportional to the manipulated variables are set. Furthermore, the control command values of the flow path switching valves 21*a*, 21*b* are set to Open or Closed so as to connect the actuators to the closed-circuit pumps 11 to 14 and open-circuit pumps 15 to 18 corresponding to the operating commands of the operating levers 19*a* to 19*d*. At this time, the control command values of the assist valves 23*a*, 23*b*, 24*a*, 24*b* are set to Open, and the control command values of the auxiliary control valves 26*a* to 27*b* are set to Closed.

Next, the operations of the hydraulic drive devices according to the first embodiment will be described. Firstly, the state of the hydraulic circuit when both engines 9*a*, 9*b* are operating normally will be described. When the operator operates all of the operating levers 19*a* to 19*d* to give inputs for driving the boom cylinder 1, the arm cylinder 3, the bucket cylinder 5, and the hydraulic motor 7, the manipulated variable detection section 20*a* in the control device 20 receives the manipulated variables of the operating levers 19*a* to 19*d* through signal lines. The engine failure detection section 20*b* obtains the operational information of the engines 9*a*, 9*b* through signal lines to determine whether or not the engines 9*a*, 9*b* are operating normally.

As shown in FIG. 6, if the engines 9*a*, 9*b* are operating normally, the flow rate calculation section 20*c* proceeds to the step S3, where the values obtained by multiplying the manipulated variables by, for example, a preset proportional gain are set as the discharge flow rate command values of the closed-circuit pumps 11 to 14 and the open-circuit pumps 15 to 18, and the control command values of the flow path switching valves 21*a*, 21*b* are set so as to connect, through flow paths, the closed-circuit pump 11 to the boom cylinder 1, the closed-circuit pump 12 to the arm cylinder 3, the closed-circuit pump 13 to the bucket cylinder 5, and the closed-circuit pump 14 to the hydraulic motor 7. Furthermore, the flow rate calculation section 20*c* sets the control command values of the assist valves 23*a*, 23*b*, 24*a*, 24*b* to Open, and sets the control command values of the auxiliary control valves 26*a* to 27*b* to Closed.

The pump/valve control section 20*d* outputs control signals to the closed-circuit pumps 11 to 14, the open-circuit pumps 15 to 18, and the flow path switching valves 21*a*, 21*b* in accordance with the control command values from the flow rate calculation section 20*c*. Furthermore, the emergency circuit control section 20*e* outputs opening control signals to the assist valves 23*a*, 23*b*, 24*a*, 24*b* and closing control signals to the auxiliary control valves 26*a* to 27*b* in accordance with the control command values from the flow rate calculation section 20*c*.

Figure 3:
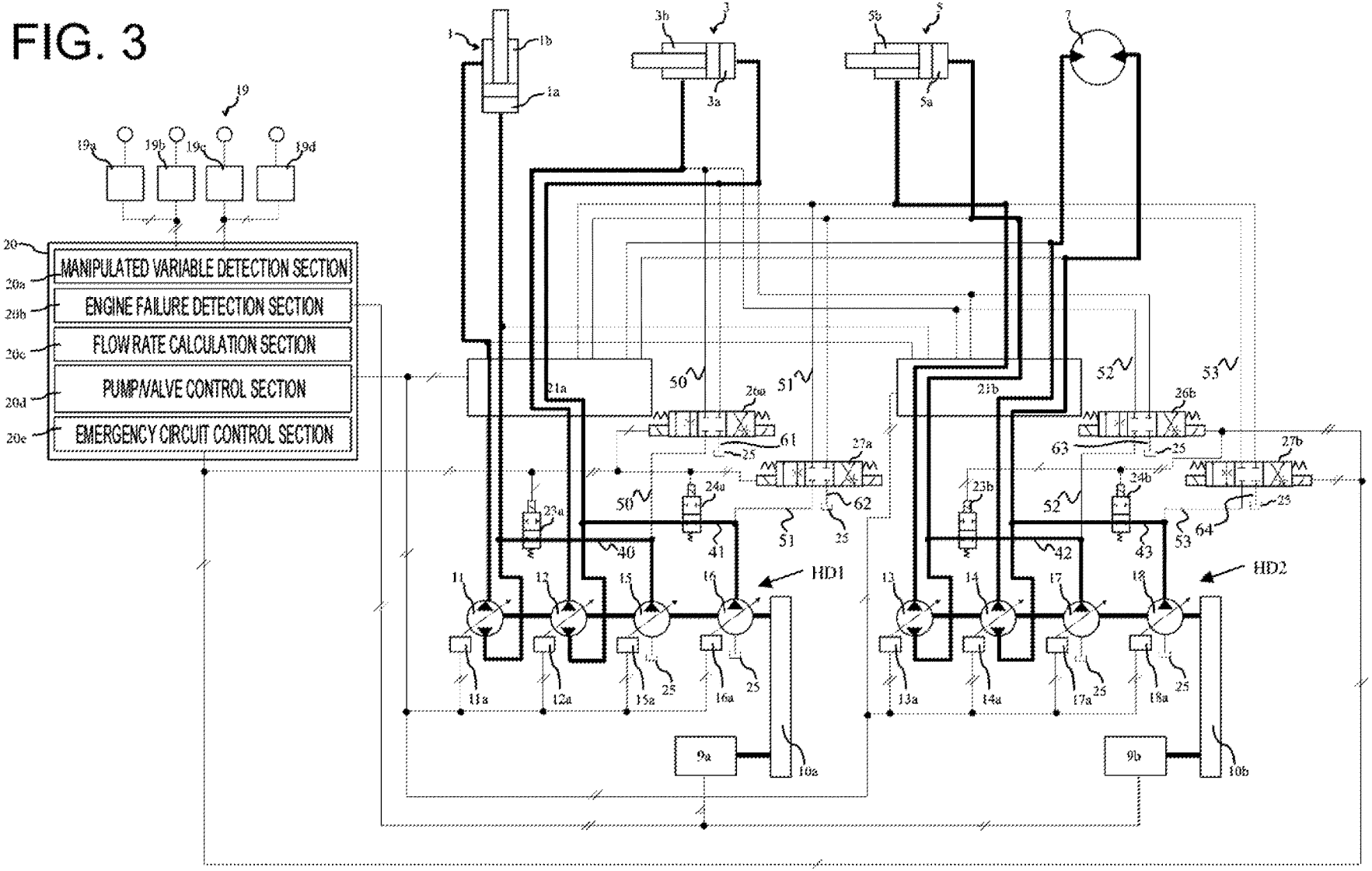
FIG. 3 is a schematic view showing the flow of pressure oil in a hydraulic circuit during normal operation with respect to a construction machine according to the first embodiment of the present invention.

FIG. 3 shows the flow of pressure oil in the hydraulic circuit during normal operation. It should be noted that the bold line in the figure indicates a circuit through which pressure oil flows. The regulators 11*a* to 18*a* receive control signals from the pump/valve control section 20*d* through signal lines to control the discharge flow rates of the closed-circuit pumps 11 to 14 and the open-circuit pumps 15 to 18. The closed-circuit pump 11 discharges hydraulic oil to the boom head 1*a* of the boom cylinder 1 via the flow path switching valve 21*a* to extend the boom cylinder 1 (closed circuit 11-1). At this time, the hydraulic oil discharged from the open-circuit pump 15 merges with the hydraulic oil discharged from the closed-circuit pump 11 via the assist valve 23*a* and flows (assist flow path 40) via the flow path switching valve 21*a* into the boom head 1*a*.

The closed-circuit pump 12 discharges hydraulic oil to the arm head 3*a* of the arm cylinder 3 via the flow path switching valve 21*a* to extend the arm cylinder 3 (closed circuit 12-3). At this time, the hydraulic oil discharged from the open-circuit pump 16 merges with the hydraulic oil discharged from the closed-circuit pump 12 via the assist valve 24*a* and flows (assist flow path 41) via the flow path switching valve 21*a* into the arm head 3*a*.

The closed-circuit pump 13 discharges hydraulic oil to the bucket head 5*a* of the bucket cylinder 5 via the flow path switching valve 21*b* to extend the bucket cylinder 5 (closed circuit 13-5). At this time, the hydraulic oil discharged from the open-circuit pump 17 merges with the hydraulic oil discharged from the closed-circuit pump 13 via the assist valve 23*b* and flows (assist flow path 42) via the flow path switching valve 21*b* into the bucket head 5*a*.

The closed-circuit pump 14 discharges hydraulic oil to the hydraulic motor 7 via the flow path switching valve 21*b* to rotate the hydraulic motor 7 (closed circuit 14-7). At this time, the hydraulic oil discharged from the open-circuit pump 18 merges with the hydraulic oil discharged from the closed-circuit pump 14 via the assist valve 24*b*, and flows (assist flow path 43) via the flow path switching valve 21*b* into the hydraulic motor 7. Thus, all the actuators of the boom cylinder 1, the arm cylinder 3, the bucket cylinder 5, and the hydraulic motor 7 are simultaneously driven by the two engines 9*a*, 9*b*.

Next, the state of the hydraulic circuit when one of the engines is inoperative will be described. Here, explanation will be given assuming the cases where an abnormality occurs in the engine 9*b*. If the engine 9*b* is determined to be faulty, the flow rate calculation section 20*c* proceeds to the step S5 in FIG. 6, where the values obtained by multiplying the manipulated variables by, for example, a preset proportional gain is set as the discharge flow rate command values of the closed-circuit pumps 11, 12 and the open-circuit pumps 15, 16, and the discharge flow rate command values of the closed-circuit pumps 13, 14 and the open-circuit pumps 17, 18 are set to 0.

Further, the control command value of the flow path switching valve 21*a* is set so as to connect, through flow paths, the closed-circuit pump 11 to the boom cylinder 1, and the closed-circuit pump 12 to the hydraulic motor 7. At this time, the closing command value is set for the flow path switching valve 21*b*.

The flow rate calculation section 20*c* sets the control command values of the assist valves 23*a*, 23*b*, 24*a*, 24*b* to Closed and sets the auxiliary control valves 26*a*, 27*a* to opening command values corresponding to the operation directions and manipulated variables instructed by the operation levers 19*c*, 19*d*. Furthermore, the control command values of the auxiliary control valves 26*b*, 27*b* are set to Closed.

The pump/valve control section 20*d* outputs control signals to the closed-circuit pumps 11 to 14, the open-circuit pumps 15 to 18, and the flow path switching valves 21*a*, 21*b* in accordance with the control command values from the flow rate calculation section 20*c*. Furthermore, the emergency circuit control section 20*e* outputs closing control signals to the assist valves 23*a*, 23*b*, 24*a*, 24*b* and opening control signals to the auxiliary control valves 26*a* to 27*b* in accordance with the control command values from the flow rate calculation section 20*c*.

Figure 4:
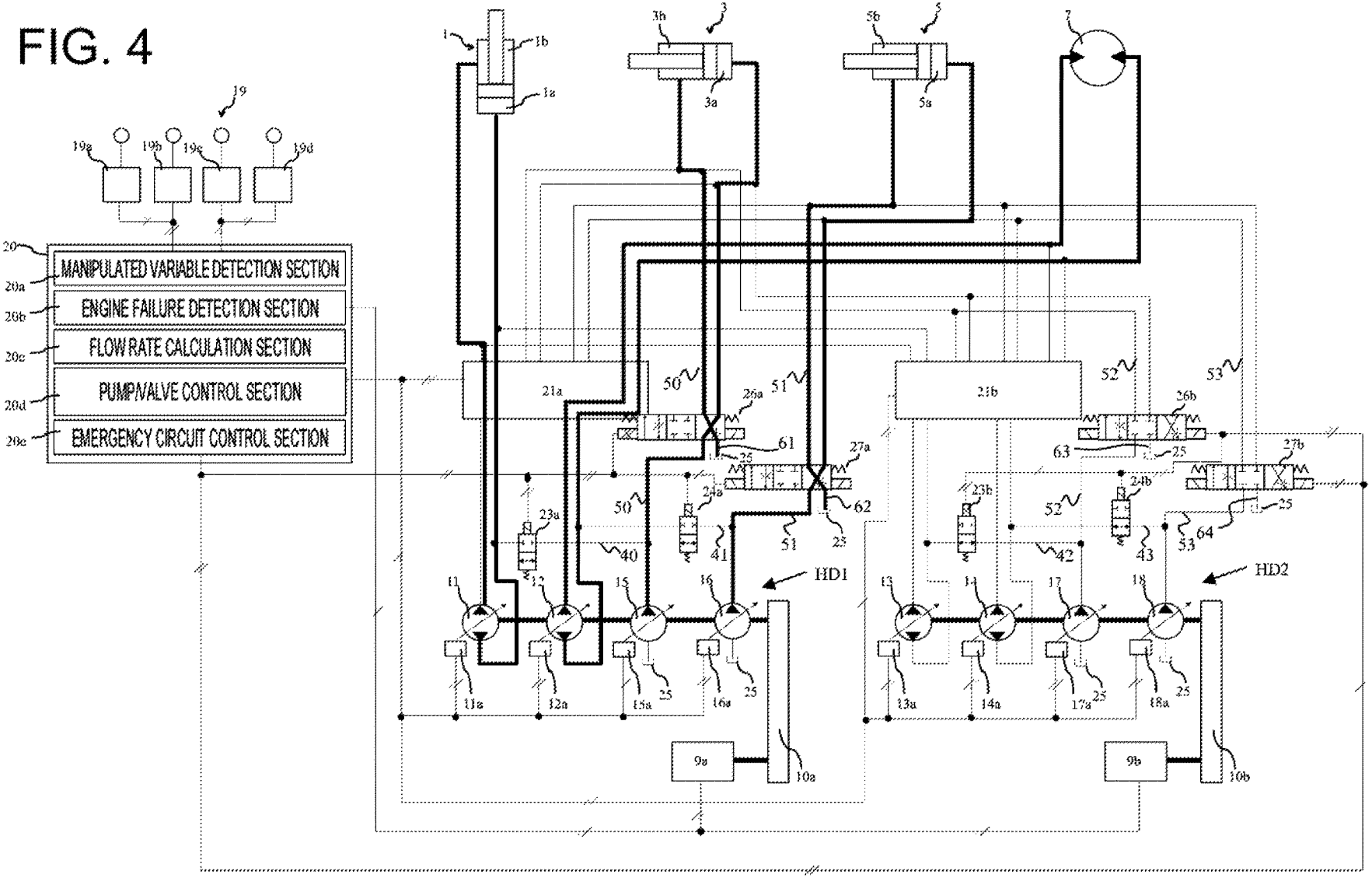
FIG. 4 is a schematic view showing the flow of pressure oil in the hydraulic circuit when one of engines is faulty (inoperative) with respect to the construction machine according to the first embodiment of the present invention.

FIG. 4 shows the flow of pressure oil in the hydraulic circuit when the engine 9*b* is inoperative. It should be noted that the bold line in the figure indicates a circuit through which pressure oil flows. The regulators 11*a* to 18*a* receive control signals from the pump/valve control section 20*d* through signal lines and control the delivery flow rates of the closed-circuit pumps 11 to 14 and the open-circuit pumps 15 to 18. The closed-circuit pump 11 discharges hydraulic oil to the boom head 1*a* of the boom cylinder 1 via the flow path switching valve 21*a* to extend the boom cylinder 1 (closed circuit 11-1). The closed-circuit pump 12 discharges hydraulic oil to the hydraulic motor 7 via the flow path switching valve 21*a* to rotate the hydraulic motor 7 (closed circuit 12-7: first emergency closed circuit).

Meanwhile, the hydraulic oil discharged from the open-circuit pump 15 flows into the arm head 3*a* via the auxiliary control valve 26*a* and extends the arm cylinder 3 (emergency flow path 50). The hydraulic oil discharged from the open-circuit pump 16 flows via the auxiliary control valve 27*a* into the bucket head 5*a* and extends the bucket cylinder 5 (emergency flow path 51). Thus, all the actuators of the boom cylinder 1, the arm cylinder 3, the bucket cylinder 5, and the hydraulic motor 7 are simultaneously driven by the single engine 9*a*.

Next, the advantageous effect of the hydraulic excavator according to this embodiment will be described. If a known hydraulic closed-circuit system is applied to the hydraulic circuit device of a large-sized hydraulic shovel equipped with two engines and driving of four hydraulic actuators is desired even when one of the engines is inoperative, four closed-circuit pumps have been required to drive all four actuators for one engine. However, this embodiment is configured such that, when one engine is inoperative, the open-circuit pump connected to a closed circuit is connected to a closed circuit connected to the inoperative engine so as to allow the other hydraulic actuators to operate with the open-circuit pump. Thus, it is possible to reduce the number of closed-circuit pumps to half. In addition, hydraulic piping is also simplified by reducing the number of closed-circuit pumps.

That is, in this embodiment, even if one of the two engines fails to operate, the minimum combined operations of the four hydraulic actuators can be performed by the remaining engine. Thus, even if, for example, an engine trouble occurs, it is possible to perform the minimum emergency operation, such as retracting the hydraulic excavator or returning the front working device 104 to a stable orientation. Moreover, since the number of closed-circuit pumps can be reduced, hydraulic piping can be simplified. Furthermore, this embodiment is configured such that, when the engine 9*b* is inoperative, the boom cylinder 1 and the hydraulic motor 7 are driven by the closed-circuit pumps 11, 12, and the arm cylinder 3 and the bucket cylinder 5 are driven by the open-circuit pumps 15, 16. Thus, the advantage is also obtained that the behavior of the combined operations of the four hydraulic actuators under abnormal conditions is stabilized.

Second Embodiment

Next, a second embodiment of the present invention will be described using FIGS. 7 to 11. In the following description, identical configurations to those of the first embodiment are denoted with identical reference marks, and therefore, the description thereof will not be given here.

Figure 7:
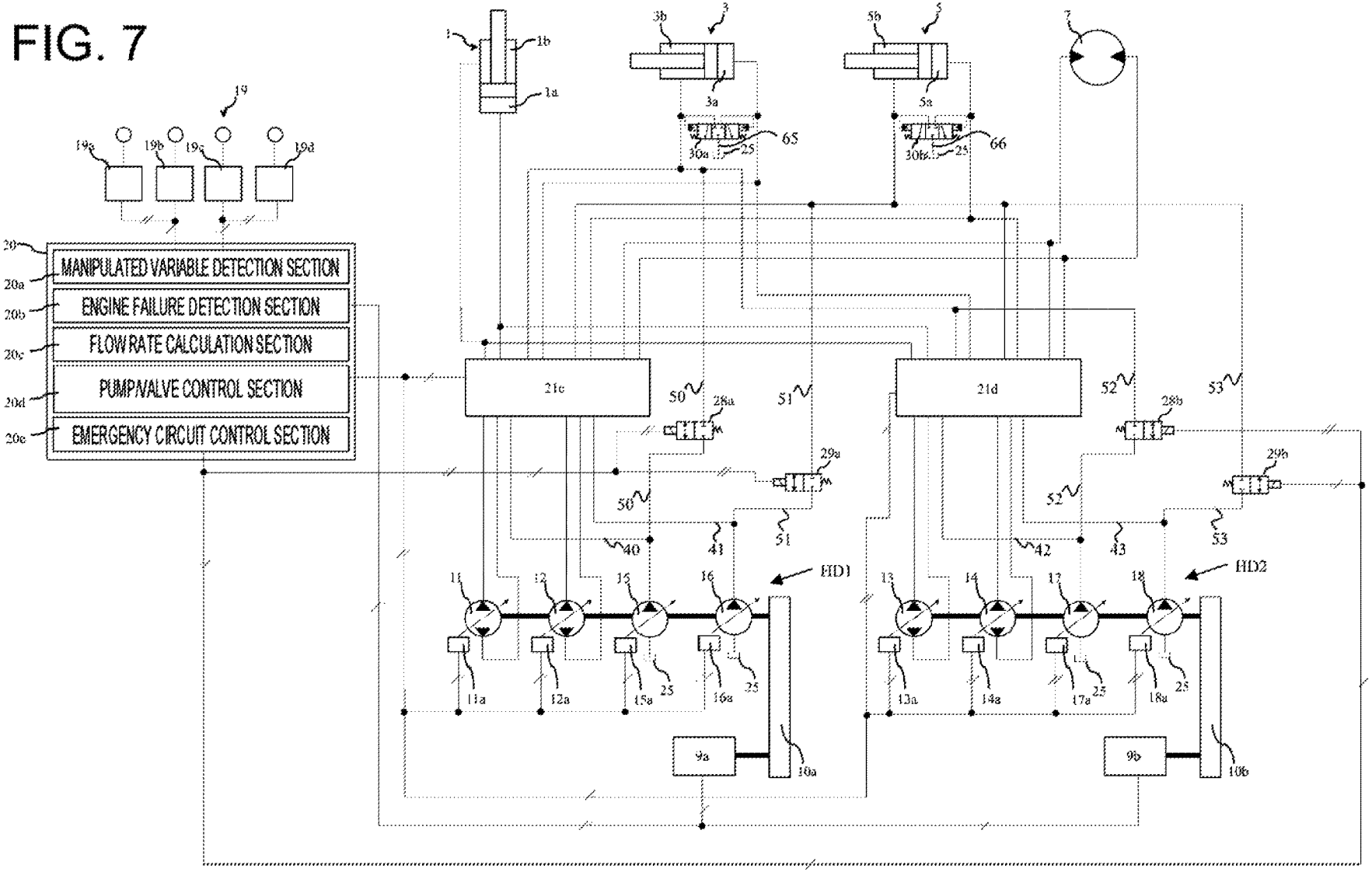
FIG. 7 is a schematic diagram showing hydraulic drive devices constituting a construction machine according to a second embodiment of the present invention.

The second embodiment is mainly different from the first embodiment in that the assist valves 23*a* to 24*b* of the first embodiment shown in FIG. 3 are not used. FIG. 7 is a hydraulic circuit diagram showing hydraulic drive devices for driving a hydraulic excavator and a control device according to the second embodiment.

As shown in FIG. 7, in the second embodiment, the discharge-side flow paths of the open-circuit pumps 15, 16 are connected to a flow path switching valve (first closed-circuit switching device) 21*c*, and the discharge side of the open-circuit pumps 17, 18 is connected to a flow path switching valve (second closed-circuit switching device) 21*d*. The flow path switching valves 21*c*, 21*d* have the function of connecting the closed-circuit pumps 11 to 14 to the boom cylinder 1, the arm cylinder 3, the bucket cylinder 5, or the hydraulic motor 7, also connecting the open-circuit pumps 15 to 18 to the boom head 1*a*, the arm head 3*a*, or the bucket head 5*a*, and merging the hydraulic oil discharged from the open-circuit pumps 15 to 18 with the hydraulic oil discharged from the closed-circuit pumps 11 to 14, in accordance with the control command values received from the control device 20 through signal lines.

Furthermore, the flow paths branching from the discharge-side flow paths of the open-circuit pumps 15 to 18 are connected to the arm rod 3*b* and the bucket rod 5*b* via rod assist valves (first assist switching devices, second assist switching devices) 28*a*, 29*a*, 28*b*, 29*b*. The opening and closing of the rod assist valves 28*a*, 29*a*, 28*b*, 29*b* are controlled in accordance with the control command values received from the control device 20 through signal lines.

A flushing valve 30*a* branches from the flow paths connected to the arm head 3*a* and the arm rod 3*b* and is connected thereto. The flushing valve 30*a* connects the low-pressure side flow path among the flow paths connected to the flushing valve 30*a* and the tank 25 through a hydraulic oil return flow path (second hydraulic oil return flow path) 65. Furthermore, a flushing valve 30*b* branches from the flow paths connected to the bucket head 5*a* and the bucket rod 5*b* and is connected thereto. The flushing valve 30*b* connects the low-pressure side flow path among the flow paths connected to the flushing valve 30*b* and the tank 25 through a hydraulic oil return flow path (first hydraulic oil return flow path) 66.

Next, the operations of the hydraulic drive devices according to the second embodiment will be described. Firstly, the state of the hydraulic circuit in cases where both engines 9*a*, 9*b* are operating normally will be described using FIG. 7. When the operator operates all of the operating levers 19*a* to 19*d* to give inputs for driving the boom cylinder 1, the arm cylinder 3, and the bucket cylinder 5 in the extension direction and rotationally driving the hydraulic motor 7 clockwise, the manipulated variable detection section 20*a* in the control device 20 receives the manipulated variables of the operating levers 19*a* to 19*d* through signal lines. The engine failure detection section 20*b* obtains the operational information of the engines 9*a*, 9*b* through signal lines and determines whether or not the engines 9*a*, 9*b* are operating normally. The flow rate calculation section 20*c* determines the control flow rates of the hydraulic actuators on the basis of the manipulated variables from the manipulated variable detection section 20*a* and the information from the engine failure detection section 20*b*.

Figure 11:
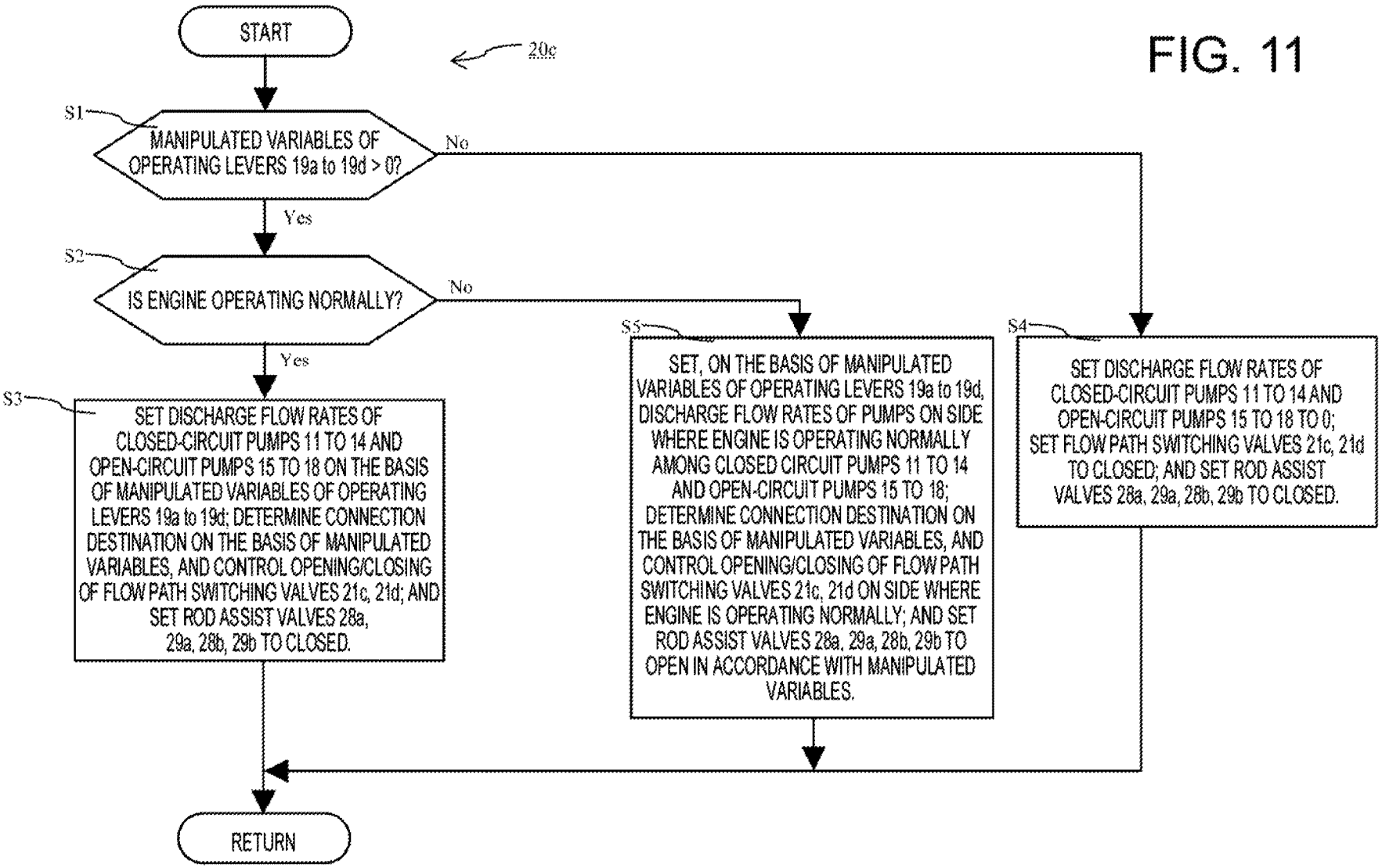
FIG. 11 is a flowchart showing the processing contents of a flow path calculation section of the control device constituting the construction machine according to the second embodiment of the present invention.

Next, the details of the flow rate calculation section 20*c* will be described using FIG. 11. FIG. 11 is a flowchart showing the procedure of control processing according to the second embodiment. If the engines 9*a*, 9*b* are operating normally, the process proceeds to step S3, where the values obtained by multiplying the manipulated variables by, for example, a preset proportional gain is set as the discharge flow rate command values of the closed-circuit pumps 11 to 14 and the open-circuit pumps 15 to 18, and the control command values of the flow path switching valves 21*c*, 21*d* are set so as to connect, through flow paths, the closed-circuit pump 11 to the boom cylinder 1, the closed-circuit pump 12 to the arm cylinder 3, the closed-circuit pump 13 to the bucket cylinder 5, and the closed-circuit pump 14 to the hydraulic motor 7.

Furthermore, the control command values of the flow path switching valves 21*c*, 21*d* are set so as to connect, through flow paths, the open-circuit pump 15 to the boom head 1*a*, the open-circuit pump 16 to the arm head 3*a*, the open-circuit pump 17 to the bucket head 5*a*, and the open-circuit pump 18 to the hydraulic motor 7. The flow rate calculation section 20*c* sets the control command values of the rod assist valves 28*a*, 29*a*, 28*b*, 29*b* to Closed.

The pump/valve control section 20*d* outputs control signals to the closed-circuit pumps 11 to 14, the open-circuit pumps 15 to 18, and the flow path switching valves 21*c*, 21*d* in accordance with the control command values from the flow rate calculation section 20*c*. Furthermore, the emergency circuit control section 20*e* outputs closing control signals to the rod assist valves 28*a*, 29*a*, 28*b*, 29*b* in accordance with the control command values from the flow rate calculation section 20*c*.

Figure 8:
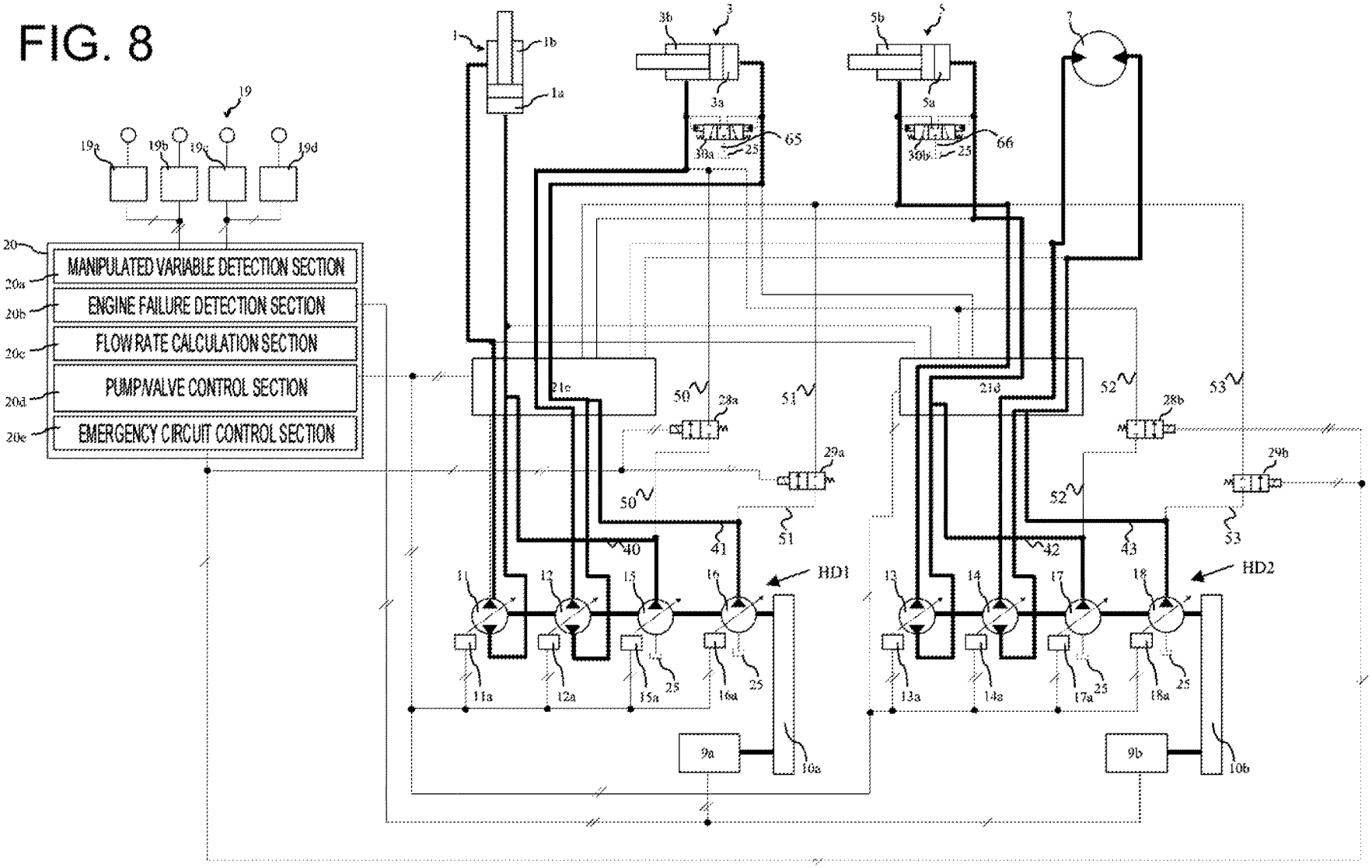
FIG. 8 is a schematic view showing the flow of pressure oil in a hydraulic circuit during normal operation with respect to the construction machine according to the second embodiment of the present invention.

FIG. 8 shows the flow of pressure oil in the hydraulic circuit. It should be noted that the bold line in the figure indicates a circuit through which pressure oil flows. The regulators 11*a* to 18*a* receive control signals from the pump/valve control section 20*d* through signal lines to control the discharge flow rates of the closed-circuit pumps 11 to 14 and the open-circuit pumps 15 to 18. The closed-circuit pump 11 discharges hydraulic oil to the boom head 1*a* of the boom cylinder 1 via the flow path switching valve 21*c* to extend the boom cylinder 1 (closed circuit 11-1). At this time, the hydraulic oil discharged from the open-circuit pump 15 merges with the hydraulic oil discharged from the closed-circuit pump 11 via the flow path switching valve 21*c* and flows (assist flow path 40) into the boom head 1*a*.

The closed-circuit pump 12 discharges hydraulic oil to the arm head 3*a* of the arm cylinder 3 via the flow path switching valve 21*c* to extend the arm cylinder 3 (closed circuit 12-3). At this time, the hydraulic oil discharged from the open-circuit pump 16 flows (assist flow path 41) via the flow path switching valve 21*c* into the arm head 3*a*.

The closed-circuit pump 13 discharges hydraulic oil to the bucket head 5*a* of the bucket cylinder 5 via the flow path switching valve 21*d* to extend the bucket cylinder 5 (closed circuit 13-5). At this time, the hydraulic oil discharged from the open-circuit pump 17 flows (assist flow path 42) via the flow path switching valve 21*d* into the bucket head 5*a*.

The closed-circuit pump 14 discharges hydraulic oil to the hydraulic motor 7 via the flow path switching valve 21*d* to rotate the hydraulic motor 7 (closed circuit 14-7). At this time, the hydraulic oil discharged from the open-circuit pump 18 flows (assist flow path 43) via the flow path switching valve 21*d* into the hydraulic motor 7. Thus, all the actuators of the boom cylinder 1, the arm cylinder 3, the bucket cylinder 5, and the hydraulic motor 7 are simultaneously driven by the two engines 9*a*, 9*b*.

Next, a description will be given, using FIGS. 9 to 11, of the maintenance of the state in which the minimum work can be carried out when one engine 9*b* in the second embodiment is faulty (inoperative).

Figure 10:
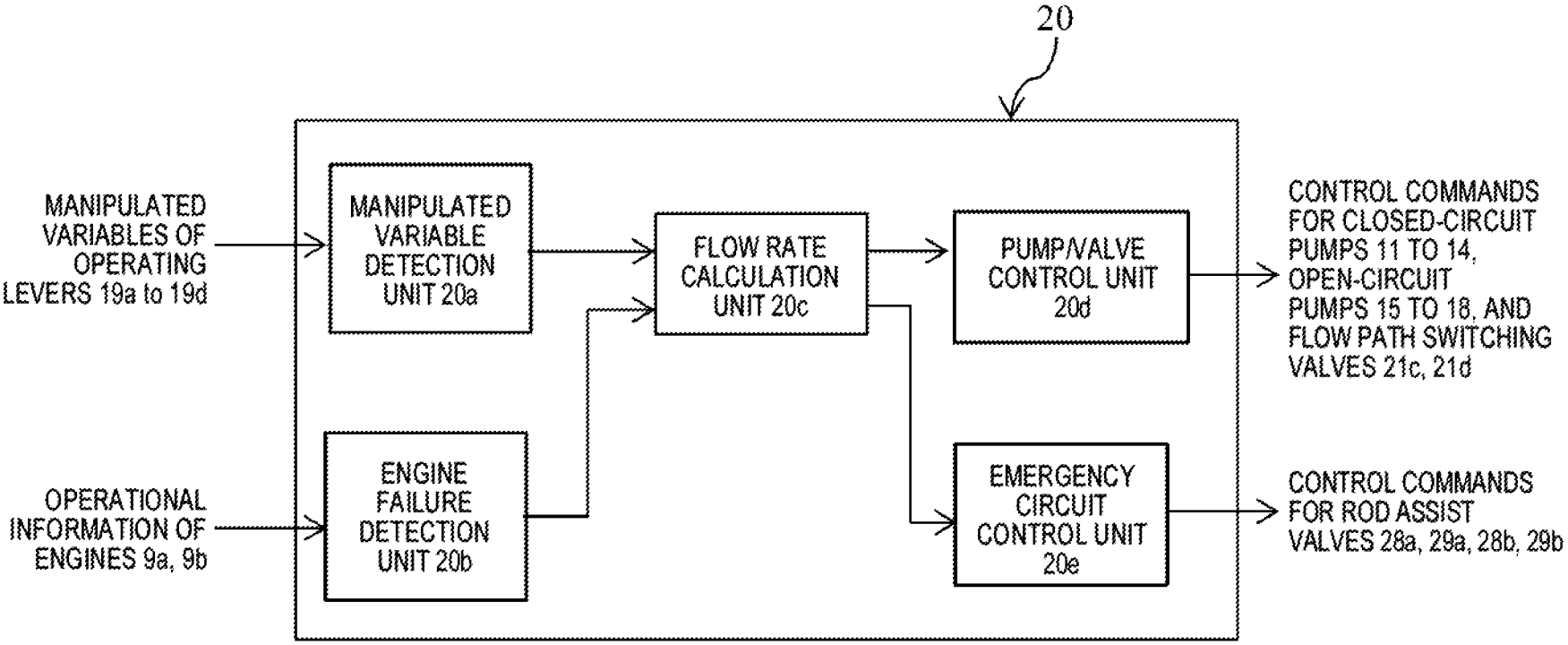
FIG. 10 is a conceptual diagram showing the configuration of a control device constituting the construction machine according to the second embodiment of the present invention.

When the operator operates all of the operating levers 19*a* to 19*d* to give inputs for driving the boom cylinder 1, the arm cylinder 3, and the bucket cylinder 5 in the extension direction and rotationally driving the hydraulic motor 7 clockwise, the manipulated variable detection section 20*a* in the control device 20 shown in FIG. 10 receives the manipulated variables of the operating levers 19*a* to 19*d* through signal lines.

The engine failure detection section 20*b* obtains the operational information of the engines 9*a*, 9*b* through signal lines and determines whether or not the engines 9*a*, 9*b* are operating normally. If the engine 9*b* is determined to be faulty, as shown in FIG. 11, the flow rate calculation section 20*c* proceeds to the step S5, where the values obtained by multiplying the manipulated variables by, for example, a preset proportional gain is set as the discharge flow rate command values of the closed-circuit pumps 11, 12 and the open-circuit pumps 15, 16, and the discharge flow rate command values of the closed-circuit pumps 13, 14 and the open-circuit pumps 17, 18 are set to 0. Furthermore, the control command value of the flow path switching valve 21*c* is set so as to connect, through flow paths the closed-circuit pump 11 to the boom cylinder 1, the closed-circuit pump 12 to the hydraulic motor 7, the open-circuit pump 15 to the arm head 3*a*, and the open-circuit pump 16 to the bucket head 5*a*. At this time, the control command value of the flow path switching valve 21*d* is set to Closed. Furthermore, the flow rate calculation section 20*c* sets the control command values of the rod assist valves 28*a*, 29*a*, 28*b*, 29*b* to Open.

The pump/valve control section 20*d* outputs control signals to the closed-circuit pumps 11 to 14, the open-circuit pumps 15 to 18, and the flow path switching valves 21*c*, 21*d* in accordance with the control command values from the flow rate calculation section 20*c*. Furthermore, the emergency circuit control section 20*e* outputs control signals to the rod assist valves 28*a*, 29*a*, 28*b*, 29*b* in accordance with the control command values from the flow rate calculation section 20*c*.

Figure 9:
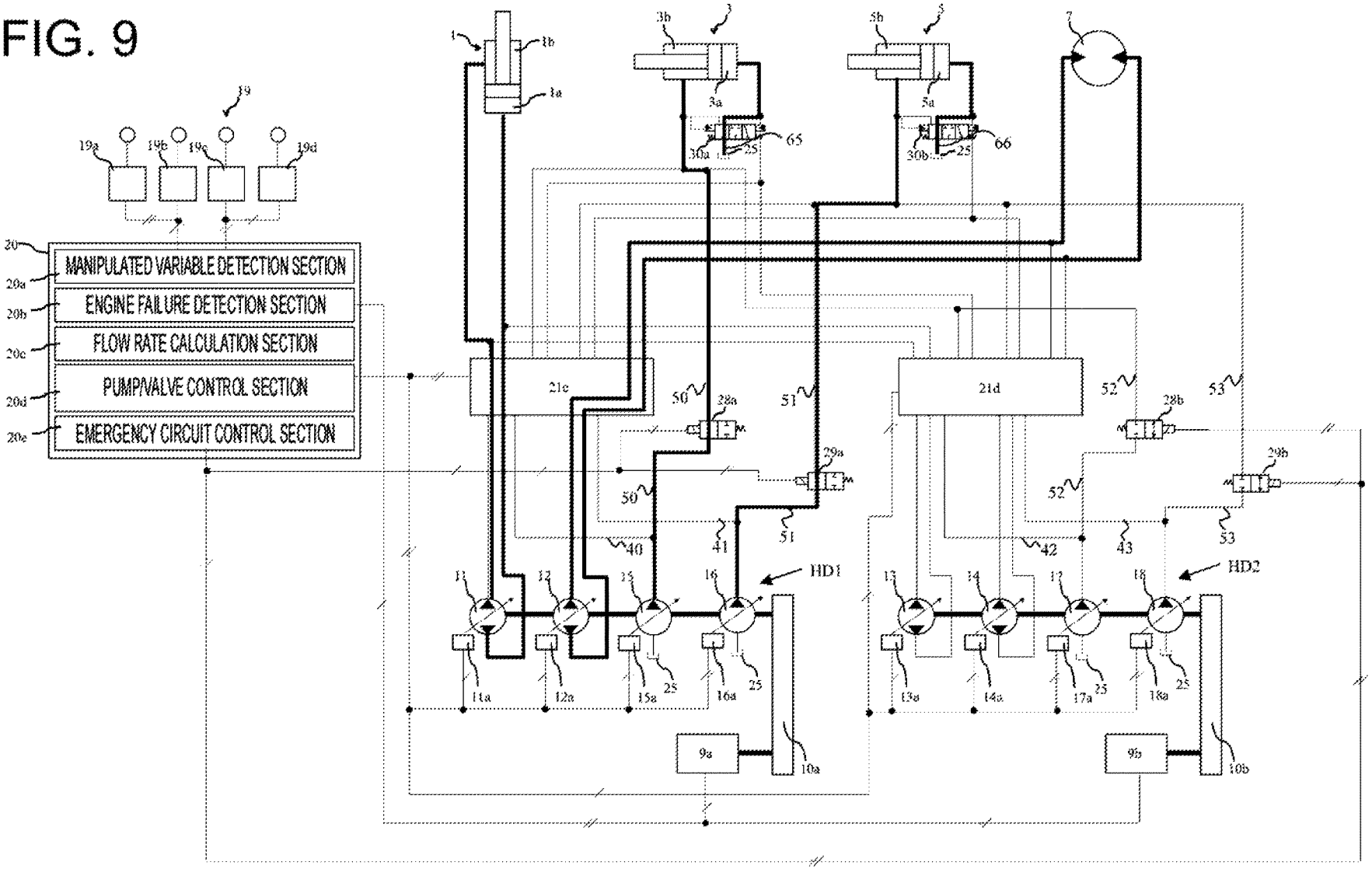
FIG. 9 is a schematic view showing the flow of pressure oil in the hydraulic circuit when one of engines is faulty (inoperative) with respect to the construction machine according to the second embodiment of the present invention.

FIG. 9 shows the flow of pressure oil in the hydraulic circuit. It should be noted that the bold line in the figure indicates a circuit through which pressure oil flows. The regulators 11*a* to 18*a* receive control signals from the pump/valve control section 20*d* through signal lines to control the discharge flow rates of the closed-circuit pumps 11 to 14 and the open-circuit pumps 15 to 18. The closed-circuit pump 11 discharges hydraulic oil to the boom head 1*a* of the boom cylinder 1 via the flow path switching valve 21*c* to extend the boom cylinder 1 (closed circuit 11-1). The closed-circuit pump 12 discharges hydraulic oil to the hydraulic motor 7 via the flow path switching valve 21*c* to rotate the hydraulic motor 7 (closed circuit 12-7: first emergency closed circuit).

The hydraulic oil discharged from the open-circuit pump 15 flows into the arm head 3*a* via the rod assist valve 28*a* and extends the arm cylinder 3 (emergency flow path 50). At this time, the hydraulic oil flowing from the arm rod 3*b* flows through the hydraulic oil return flow path 65 via the flushing valve 30*a* and flows out into the tank 25.

The hydraulic oil discharged from the open-circuit pump 16 flows via the rod assist valve 29*a* into the bucket head 5*a* and extends the bucket cylinder 5 (emergency flow path 51). At this time, the hydraulic oil flowing from the bucket rod 5*b* flows through the hydraulic oil return flow path 65 via the flushing valve 30*b* and flows out into the tank 25. Thus, all the actuators of the boom cylinder 1, the arm cylinder 3, the bucket cylinder 5, and the hydraulic motor 7 are simultaneously driven by the single engine 9*a*.

Meanwhile, when the engine 9*b* is inoperative and the operator operates all of the operating levers 19*a* to 19*d* to give inputs for driving the boom cylinder 1, the arm cylinder 3, and the bucket cylinder 5 in the contraction direction and rotationally driving the hydraulic motor 7 counterclockwise, the flow rate calculation section 20*c* in the control device 20 shown in FIG. 10 sets the control command values of the flow path switching valve 21*c* so that the closed-circuit pump 11 is connected to the boom cylinder 1 and the closed-circuit pump 12 is connected to the hydraulic motor 7. The flow rate calculation section 20*c* also sets the control command values of the rod assist valves 28*a*, 29*a* to Open so that the open-circuit pump 15 is connected to the arm rod 3*b* and the open-circuit pump 16 is connected to the bucket rod 5*b*, by respective flow paths.

The pump/valve control section 20*d* outputs control signals to the closed-circuit pumps 11 to 14, the open-circuit pumps 15 to 18, and the flow path switching valves 21*c*, 21*d* in accordance with the control command values from the flow rate calculation section 20*c*. Furthermore, the emergency circuit control section 20*e* outputs control signals to the rod assist valves 28*a*, 29*a*, 28*b*, 29*b* in accordance with the control command values from the flow rate calculation section 20*c*. The regulators 11*a* to 18*a* shown in FIG. 7 receive control signals from the pump/valve control section 20*d* through signal lines to control the discharge flow rates of the closed-circuit pumps 11 to 14 and the open-circuit pumps 15 to 18.

In FIG. 9, the closed-circuit pump 11 discharges hydraulic oil to the boom head 1*a* of the boom cylinder 1 via the flow path switching valve 21*c* to contract the boom cylinder 1. The closed-circuit pump 12 discharges hydraulic oil to the hydraulic motor 7 via the flow path switching valve 21*c* to rotate the hydraulic motor 7. The hydraulic oil discharged from the open-circuit pump 15 flows via the rod assist valve 28*a* into the arm rod 3*b* and contracts the arm cylinder 3. At this time, the hydraulic oil flowing from the arm head 3*a* flows out into the tank 25 via the flushing valve 30*a*. The hydraulic oil discharged from the open-circuit pump 16 flows via the rod assist valve 29*a* into the bucket rod 5*b* and contracts the bucket cylinder 5. At this time, the hydraulic oil flowing from the bucket head 5*a* flows out into the tank 25 via the flushing valve 30*b*. Thus, all the actuators of the boom cylinder 1, the arm cylinder 3, the bucket cylinder 5, and the hydraulic motor 7 are simultaneously driven.

Next, the advantageous effect of the second embodiment will be described. For example, in the first embodiment, a lot of hydraulic equipment and control thereof are required in cases where one of the engines is faulty, and therefore, for example, in order to shut off the assist flow paths where the hydraulic oil from the open-circuit pumps 15 to 18 merge with the hydraulic oil from the closed-circuit pumps 11 to 14, it is necessary to provide the assist valves 23*a* to 24*b* and close the assist valves, and also to control the connection direction of the auxiliary control valves.

Meanwhile, in the second embodiment, a merging circuit of the open-circuit pumps 15 to 18 to the cylinder head side is added to the flow path switching valves 21*c* and 21*d*, thereby eliminating the need for the assist valves 23*a* to 24*b* which are needed in the first embodiment. Further, since the direction switching functions of the auxiliary control valves 26*a* to 27*b* become unnecessary, simple switching valves, such as the rod assist valves 28*a*, 28*b*, 29*a* and 29*b*, are sufficient. Thus, it is possible to simplify the hydraulic circuit configuration while maintaining the function capable of suppressing the reduction in working efficiency in the event of failure of one of the engines, and to reduce the installation cost or the like.

In the above embodiments, the cases where the present invention is applied to a hydraulic excavator have been described as an example, but also the present invention can be applied to construction machines other than hydraulic excavators. For example, the present invention can be applied to general construction machines provided with a hydraulic device in which a plurality of hydraulic cylinders are driven by closed circuits in a work device, such as a hydraulic crane equipped with two or more engines. A double-tilting pump/motor may alternatively be used in place of the closed-circuit pumps 11 to 14. In this case, energy regeneration is also possible.

REFERENCE SIGNS LIST

1 . . . Boom cylinder (first hydraulic actuator)
2 . . . Boom
3 . . . Arm cylinder (first hydraulic actuator)
4 . . . Arm
5 . . . Bucket cylinder (second hydraulic actuator)
6 . . . Bucket
7 . . . Hydraulic motor (second hydraulic actuator)
9*a*, 9*b* . . . Engine (Prime mover)
11, 12 . . . Closed-circuit pump (first closed-circuit pump)
13, 14 . . . Closed-circuit pump (second closed-circuit pump)
15, 16 . . . Open-circuit pump (first open-circuit pump)
17, 18 . . . Open-circuit pump (second open-circuit pump)
19 . . . Operating device
20 . . . Control device
20*b* . . . Engine failure detection section
21*a* . . . Flow path switching valve (first closed-circuit switching device)
21*b* . . . Flow path switching valve (second closed-circuit switching device)
21*c* . . . Flow path switching valve (first closed-circuit switching device)
21*d* . . . Flow path switching valve (second closed-circuit switching device)
23*a*, 24*a* . . . Assist valve (first assist switching device)
23*b*, 24*b* . . . Assist valve (second assist switching device)
25 . . . Tank (Hydraulic oil tank)
26*a*, 27*a* . . . Auxiliary control valve (first assist switching device)
26*b*, 27*b* Auxiliary control valve (second assist switching device)
28*a*, 29*a* . . . Rod assist valve (first assist switching device)
28*b*, 29*b* . . . Rod assist valve (second assist switching device)
30*a*, 30*b* . . . Flushing valve
40, 41 . . . Assist flow path (first assist flow path)
42, 43 . . . Assist flow path (second assist flow path)
50, 51 . . . Emergency flow path (first emergency flow path)
52, 53 . . . Emergency flow path (second emergency flow path)
62, 66 . . . Hydraulic oil return flow path (first hydraulic oil return flow path)
63, 65 . . . Hydraulic oil return flow path (second hydraulic oil return flow path)
100 . . . Hydraulic excavator (construction machine)
102 . . . Upperstructure
103 . . . Undercarriage (travel base)
104 . . . Front working device (working device)
HD1 . . . First hydraulic drive device
HD2 . . . First hydraulic drive device

The invention claimed is:

1. A construction machine comprising:
a first prime mover;
a first hydraulic drive device that has a first closed-circuit pump and a first open-circuit pump being driven by the first prime mover;
a first hydraulic actuator that operates with pressure oil supplied from at least one of the first closed-circuit pump and the first open-circuit pump;
a second prime mover;
a second hydraulic drive device that has a second closed-circuit pump and a second open-circuit pump being driven by the second prime mover; and
a second hydraulic actuator that operates with pressure oil supplied from at least one of the second closed-circuit pump and the second open-circuit pump, wherein
the first hydraulic drive device has:
a first closed circuit that connects the first hydraulic actuator and the first closed-circuit pump; and
a first assist flow path that connects the first closed circuit and the first open-circuit pump and that supplies pressure oil from the first open-circuit pump to the first closed circuit, the second hydraulic drive device is provided with:
a second closed circuit that connects the second hydraulic actuator and the second closed-circuit pump, and
the construction machine further comprises:
a first emergency flow path that branches from the first assist flow path and connects to the second closed circuit and that supplies pressure oil from the first open-circuit pump to the second closed circuit;
a first assist switching device for guiding pressure oil flowing through the first assist flow path to the first emergency flow path; and
a control device that controls operation of the first assist switching device; and
if the second prime mover is inoperative, the control device switches the first assist switching device to supply pressure oil from the first open-circuit pump to the second closed circuit through the first emergency flow path to operate the second hydraulic actuator and to operate the first hydraulic actuator with pressure oil supplied from the first closed-circuit pump.

2. The construction machine according to claim 1, wherein
the second hydraulic drive device has:
a second assist flow path that connects the second closed circuit and the second open-circuit pump and that supplies pressure oil from the second open-circuit pump to the second closed circuit,
the construction machine further comprises:
a second emergency flow path that branches from the second assist flow path and connects to the first closed circuit and that supplies pressure oil from the second open-circuit pump to the first closed circuit; and
a second assist switching device for guiding pressure oil flowing through the second assist flow path to the second emergency flow path, and
the control device controls operation of the second assist switching device.

3. The construction machine according to claim 2, further comprising:
a first emergency closed circuit that connects the second hydraulic actuator and the first closed-circuit pump and that circulates pressure oil between the second hydraulic actuator and the first closed-circuit pump;

a first closed-circuit switching device for guiding, to the first emergency closed circuit, the pressure oil supplied from the first closed-circuit pump and flowing through the first closed circuit;

a second emergency closed circuit that connects the first hydraulic actuator and the second closed-circuit pump and that circulates pressure oil between the first hydraulic actuator and the second closed-circuit pump; and a second closed-circuit switching device for guiding, to the second emergency closed circuit, the pressure oil supplied from the second closed-circuit pump and flowing through the second closed circuit, wherein the control device controls operations of the first closed-circuit switching device and the second closed-circuit switching device.

4. The construction machine according to claim 3, wherein the control device includes an engine failure detection section that detects a failure in the first prime mover and the second prime mover, if it is detected by the engine failure detection section that the second prime mover is inoperative, the control device controls the operation of the first assist switching device to perform switching such that the pressure oil flowing through the first assist flow path is guided to the first emergency flow path, and also controls the operation of the first closed-circuit switching device to perform switching such that the pressure oil supplied from the first closed-circuit pump and flowing through the first closed circuit is guided to the first emergency closed circuit, so that the pressure oil is supplied to the first hydraulic actuator and the second hydraulic actuator by the first closed-circuit pump and the first open-circuit pump, and the operations of the hydraulic actuators are enabled, and if it is detected by the engine failure detection section that the first prime mover is inoperative, the control device controls the operation of the second assist switching device to perform switching such that the pressure oil flowing through the second assist flow path is guided to the second emergency flow path, and also controls the operation of the second closed-circuit switching device to perform switching such that the pressure oil supplied from the second closed-circuit pump and flowing through the second closed circuit is guided to the second emergency closed circuit, so that the pressure oil is supplied to the first hydraulic actuator and the second hydraulic actuator by the second closed-circuit pump and the second open-circuit pump, and the operations of the hydraulic actuators are enabled.

5. The construction machine according to claim 4, further comprising:

a hydraulic oil tank that stores hydraulic oil;

a first hydraulic oil return flow path that returns, to the hydraulic oil tank, the pressure oil supplied from the first open-circuit pump to the second hydraulic actuator through the first emergency flow path; and a second hydraulic oil return flow path that returns, to the hydraulic oil tank, the pressure oil supplied from the second open-circuit pump to the first hydraulic actuator through the second emergency flow path.

6. The construction machine according to claim 5, further comprising:

a travel base;

a hydraulic motor that drives the travel base;

an upperstructure that is turnably disposed on the travel base; and a working device that has a boom, a boom cylinder for driving the boom, an arm, an arm cylinder for driving the arm, a bucket, and a bucket cylinder for driving the bucket, wherein a plurality of first hydraulic actuators include the boom cylinder and the arm cylinder, a plurality of second hydraulic actuators include the bucket cylinder and the hydraulic motor, and if it is detected by the engine failure detection section that the second prime mover is inoperative, the control device controls the operations of the first assist switching device and the first closed-circuit switching device so that the boom cylinder and the hydraulic motor are operated by a plurality of first closed-circuit pumps and the arm cylinder and the bucket cylinder are operated by a plurality of first open-circuit pumps.

7. The construction machine according to claim 6, further comprising an operating device for operating the working device, wherein the control device controls the operations of the first assist switching device, the second assist switching device, the first closed-circuit switching device, and the second closed-circuit switching device in accordance with manipulated variables of the operating device.

* * * * *